US006667719B2

(12) United States Patent
LaKomski

(10) Patent No.: US 6,667,719 B2
(45) Date of Patent: Dec. 23, 2003

(54) LOGO ANTENNA

(75) Inventor: Donna Marie LaKomski, Austin, TX (US)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 10/037,367

(22) Filed: Jan. 4, 2002

(65) Prior Publication Data

US 2003/0128165 A1 Jul. 10, 2003

(51) Int. Cl.[7] ..... H01Q 1/24
(52) U.S. Cl. ..... 343/702; 343/700 MS
(58) Field of Search ..... 343/702, 700 MS, 343/767, 770, 873, 846, 711, 712, 713, 714; 455/90

(56) References Cited

U.S. PATENT DOCUMENTS 5,584,424 A * 12/1996 Stava ..... 224/240
5,657,028 A 8/1997 Sanad ..... 343/700 MS
5,918,163 A 6/1999 Rossi ..... 455/90
6,118,773 A 9/2000 Todd ..... 370/334
6,289,213 B1 9/2001 Flint et al. ..... 455/420
6,295,197 B1 9/2001 Watts, Jr. et al. ..... 361/683
6,377,222 B1 * 4/2002 Nicholson ..... 343/713
6,396,444 B1 * 5/2002 Goward et al. ..... 343/702
6,452,554 B1 * 9/2002 Aoyama et al. ..... 343/702

* cited by examiner

*Primary Examiner*—James Clinger
(74) *Attorney, Agent, or Firm*—Haynes and Boone, LLP

(57) ABSTRACT

An antenna for a wireless computer system, such as a laptop or notebook computer that is coupled to a wireless LAN. The antenna is configured in a form that provides information to the computer user and, in one embodiment, may constitute all or part of a logo that identifies an entity from whom the user acquired the computer. In one embodiment, the antenna is disposed in planar form on an enclosure associated with the computer system. Alternatively, the antenna may be printed on a printed circuit board, such as a wireless adapter PCMCIA card that includes baseband circuitry, RF circuitry, and contacts for effecting an interface to the portable computer.

20 Claims, 2 Drawing Sheets

LOGO ANTENNA

BACKGROUND

The disclosure relates to wireless computer systems and, more particularly, to antenna techniques for use in such systems.

Various communication system techniques are used to enable computers and information handling systems to communicate and exchange data and other types of information. As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

For example, computers and information handling systems are often linked by various networks, including Local Area Networks (LAN), the Internet, Ethernet and conventional telephone networks. These known communication systems, however, usually require the computer to be physically connected to telephone lines, modems or specialized hard wiring. In some locations, however, it is difficult if not impossible to be physically connected to the communication system. Additionally, these known communication systems generally cannot be used when the user is traveling to or moving between different locations.

In this regard, cellular telephone and wireless systems have been used to connect computers and information handling systems to a communication system. Cellular telephone systems are particularly effective in allowing computers and information handling systems to communicate because the computer does not need to be connected to an existing telephone line. In addition, cellular telephone systems are very useful in connection with portable computers and information handling systems because the cellular communication circuitry can be miniaturized and provided as a component of the computer.

Antennas used with cellular, or other wireless, communication systems generally include a number of antenna elements, each including a radiating element that is equal in length to some fraction of the wavelength desired to be transmitted or received. In order to increase the efficiency of communication, these known antennas must include elements that are separated by a minimum distance, and these elements are preferably orientated orthogonally to each other to provide the necessary separation and spatial diversity.

Conventional antennas used to connect a computer to a wireless communication system or cellular telephone are typically placed external to of the computer because of the noise, interference, obstruction and shielding caused by the various components include in the computer. In particular, conventional antennas do not function optimally if they are obstructed or shielded by the housing or other structures of the computer.

Conventional antennas are also generally rigid and protrude a relatively long distance from the body of the computer. These protruding antennas are often large, unwieldy, aesthetically unpleasing, and they make the computer difficult to move and transport. In addition, these antennas are often bent, broken, knocked out of alignment or otherwise damaged because they can easily catch or strike foreign objects such as people, walls, doors, and the like. Further, these known antennas require a large support structure to secure the antenna to the housing of the computer and this support structure requires a considerable amount of space inside the body of the computer. This space is very valuable, especially in small, portable computers and information handling systems. Additionally, the support structure is often damaged when the antenna is accidentally moved.

As is well known, the repair and replacement of conventional antennas and the associated support structure are difficult and costly. In fact, the entire antenna assembly is often removed and replaced rather than attempting to repair a portion of the antenna or support structure. Thus, the repair and replacement of the antenna and/or antenna support structure is expensive and time consuming.

In order to alleviate these problems, antennas are sometimes removed before the computer is moved or transported. Additionally, known antennas must often be removed before the computer can be inserted into its carrying case. Disadvantageously, this requires additional time and resources to remove and reattach the antenna each time the computer is moved. Additionally, the antenna is often misplaced, lost or damaged when it is detached from the computer. Further, because the user often is disinclined to take the time and effort to remove the antenna, the computer is moved with the antenna attached to the computer, frequently resulting in the antenna being damaged or broken.

One approach to the above operational difficulties involves the use of a telescoping antenna. For example, U.S. Pat. No. 5,684,672, *Laptop Computer With an Integrated Multi-Mode Antenna*, to Karidis, et al. discloses a laptop computer with an integrated multi-mode antenna. The telescoping antenna is integrated into the cover or display portion of the laptop and extends outwardly from the display portion for use. The telescoping antenna is then retracted into the display portion when not in use. A coaxial cable connects the antenna to the base of the computer. In particular, the coaxial cable connects the antenna to a radio frequency (RF) adapter card inserted into a Personal Computer Memory Card International Association (PCMCIA) slot in the base of the computer. Disadvantageously, the coaxial cable or connector disclosed in Karidis, et al. protrudes outwardly from the base of the computer and the user must manually extend and retract the antenna. Additionally, it is well known that an antenna should be placed in a vertical position to obtain the optimum signal strength. However, because the antenna disclosed in Karidis, et al. is attached to the display portion of the computer and the antenna is positioned parallel to the display screen, the display screen must be vertically positioned in order for the antenna to obtain the best possible signal. The vertical positioning of the screen, however, may not be the preferred viewing angle of the screen for the computer user. Further, this and other conventional antennas have limited connectivity when the display screen is in the closed position because the antenna extends in a horizontal plane and the housing of the computer may obstruct or shield the antenna.

An alternative approach to provision of an antenna for a portable computer is articulated in U.S. Pat. No. 6,181,284 B1, *"Antenna for Portable Computers and information handling systems,"* to Madsen, et al. In Madsen, et al., the antenna is positioned for use when the computer cover is opened, and is positioned in storage when the computer is closed. A storage compartment for the antenna is provided in the base unit of the laptop computer. The antenna includes a radiating element that is constructed from a flexible metallic material that tolerates repeated bending or flexing of the antenna between the use and storage positions. Additionally, the antenna has a first position in which it is generally linearly aligned and a second position in which the antenna is positioned at an angle approximately equal to 90°. Madsen, et al. discloses several mechanisms for positioning the antenna between the use and the storage positions, depending whether the computer is open or closed.

It is also known to incorporate an antenna directly onto the PCMCIA wireless adapter card. When this type of card is inserted into the PCMCIA slot in the body of the computer, the antenna extends outwardly from the body of the computer. The PCMCIA card and the computer itself, however, are easily damaged by accidental contact with the outwardly extending antenna. Thus, users of PCMCIA cards with antennas must be extremely careful when using the computer in order to avoid damage to the card and/or computer. Additionally, these PCMCIA cards with antennas generally must be removed from the PCMCIA slot in the computer whenever it is desired to store or move the computer. This requires additional time and effort by the user, and the PCMCIA card and antenna may be lost, damaged or misplaced by the user when it is not connected to the computer.

In addition, the PCMCIA card with the attached antenna often receives a degraded or impaired signal because the antenna is frequently obstructed by the computer housing and/or shadowed by the ground plane of the display. Further, the antennas of these types of PCMCIA cards typically have a ferrite core that is very brittle and it is easily broken. If the ferrite core is broken, the PCMCIA card assembly or the antenna must be repaired or replaced.

SUMMARY

The above and other objects, advantages and capabilities are achieved in one aspect of the disclosure by a wireless computer system that comprises a processor, a wireless adapter coupled to the processor and an enclosure. An antenna that is affixed to the enclosure is formed in a way that conveys visual information in addition to effectively receiving and transmitting RF signals.

In another aspect, an antenna for a personal computer system is affixed to an enclosure for the system and comprises a character formed to convey visual information that identifies a source of the personal computer system.

In a further aspect, a wireless computer system comprises a processor, a wireless adapter coupled to the processor, and an enclosure. Means contiguous to the enclosure receives signals from and transfers signals to the wireless adapter and simultaneously conveys visual information.

In a still further embodiment, the disclosure resides in a printed circuit assembly for use with a portable computer. The assembly comprises a printed circuit board with contacts for effecting an interface between the printed circuit assembly and a connector associated with the portable computer. A baseband module and an RF module are disposed on the printed circuit board. A printed circuit antenna is formed on the printed circuit board and is coupled to the RF module. In addition to transmitting/receiving RF signals, the printed circuit antenna conveys visual information.

The foregoing is a summary and thus contains, by necessity, simplifications, generalizations and omissions of detail; consequently, those skilled in the art will appreciate that the summary is illustrative only and is not intended to be in any way limiting. Other aspects, features, and advantages of the present disclosure, as defined solely by the claims, will become apparent in the non-limiting detailed description set forth below.

BRIEF DESCRIPTION OF THE DRAWINGS

The present disclosure may be better understood, and numerous objects, features, and advantages made apparent to those skilled in the art by referencing the accompanying drawings. The use of the same reference number throughout the Figures designates a like or similar element.

Figure 1:
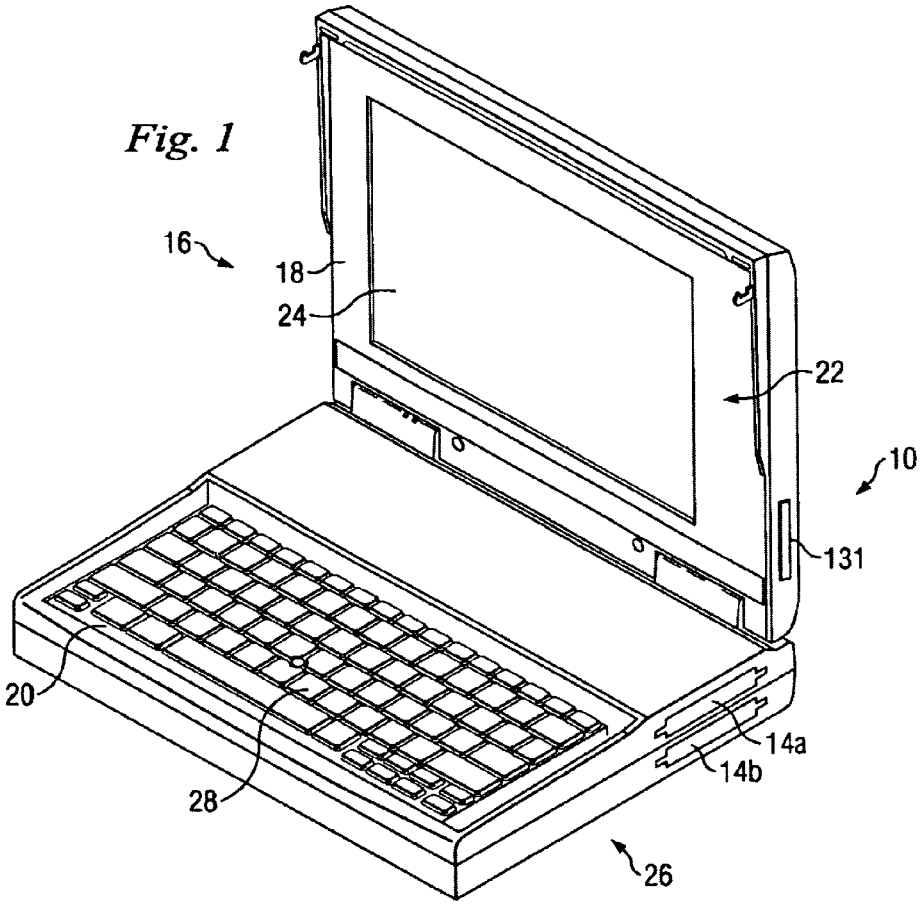
FIG. 1 is a perspective view of a portable computer system, illustrating components, features and aspects of portable computers and information handling systems that generally known in the art.

Although the disclosure is susceptible to various modifications and alternative forms, specific embodiments thereof are shown by way of example in the Drawings and will herein be described in detail. It should be understood, however, that the Drawings and Detailed Description are not intended to limit the disclosure to the particular form(s) disclosed. On the contrary, the intention is to cover all modifications, equivalents, and alternatives falling within the spirit and scope of the present disclosure as defined by the appended claims.

DETAILED DESCRIPTION

The following is intended to provide a detailed description of an example of the disclosure and should not be taken to be limiting of the disclosure itself. Rather, any number of variations may fall within the scope of the disclosure, which is defined in the claims following the description.

The present disclosure involves an antenna system for an information handling system such as a computer. Specifically, the antenna system may be deployed with portable computers and information handling systems that engage in wireless communications with a network, such as the Internet or a wireless LAN. The computer is preferably a portable computer but it will be understood that the computer may be any suitable type of general or special purpose computer. The principles of the present disclosure, however, are not limited to computers and information handling systems. It will be understood that, in light of the present disclosure, the antenna system disclosed herein can be successfully used in connection with other types of electronic devices such as cellular telephones, digital communication systems, personal digital assistants (PDA) and other information handling systems and the like.

Additionally, to assist in the description of the antenna system, words such as top, bottom, front, rear, right, left, vertical and horizontal are used to describe the accompanying Figures. It will be appreciated, however, that the antenna system of the present disclosure can be located in a variety of desired positions, including various angles, sideways and even upside down. A detailed description of the antenna system now follows.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, and a video display. The information handling system may also include one or more buses operable to transmit communications between the various hardware components.

FIG. 1 illustrates a portable computer 10 that may be used in accordance with a preferred embodiment of the present disclosure. The term portable computer 10 is to be construed comprehensively to embrace any information handling system described herein or suitable computer such as a personal computer, laptop computer, notebook computer, hand-held computer, palmtop computer or other type of computer with the desired characteristics.

The portable computer 10 includes one or more slots 14*a*, 14*b*, . . . , 14*b* (two exemplary slots are shown in FIG. 1) for accepting cards that substantially comply with applicable Personal Computer Memory Card International Association (PCMCIA) standards, but these slots are not required. The PCMCIA standards, for example, are described in detail in the PCMCIA Specification Standard Release 2.1, which is hereby incorporated by reference for all purposes. The PCMCIA specification, for example, provide standards for data storage and peripheral expansion cards. Additionally, the PCMCIA specification provides standards for input/output (I/O) capability for a standard bus extension slot so that peripherals such as modems and LAN adapters can use the bus. It will be understood, however, that while the portable computer 10 is described with respect to PCMCIA standards, the computer 10 may be used with virtually any type of circuit cards and adapter cards. Additionally, while these cards are preferably a miniature type, any suitable size and type of card may be used.

The computer 10 includes a body, enclosure or housing 16 that includes a covering or upper portion 18 and a base or lower portion 20. Located within the base 20 are various known computer circuitry components, such as processing units, printed circuit boards and memory storage devices. One skilled in the art will understand that the computer 10 may include various components, depending, for example, upon the type and configuration of the computer.

A wireless adapter that provides an interface between the computer 10 and an antenna system is also located within the base 20. The antenna system includes an antenna 30 (to be described below). The wireless adapter, for example, may include a printed circuit board and may provide processing such as RF signal processing and/or baseband processing. The adapter may also include a power source such as a battery or other device to provide power to the antenna system, but it will be understood that the antenna system may receive power from any desired source such as the computer 10 or an external power source.

The antenna system is configured to be in communication with a wireless communications network. The wireless communications network, for example, may include wireless modems, wireless LAN, wireless Personal Area Network (PAN), cellular telephone networks, digital communication systems, etc. The wireless communication network may also include Bluetooth technology. Bluetooth technology is a low-powered radio system which allows products containing Bluetooth technology to be interconnected via wireless communication.

As shown in FIG. 1, the upper portion 18 of the portable computer 10 includes a display 22 which preferably comprises a display screen 24 such as a liquid crystal display (LCD), gas plasma display or other type of suitable display. The base 20 of the computer 10 includes an input device 26 such as a keyboard 28, but other input devices such as touch screens, pointing devices, numeric pads, etc. may also be used. As known to those skilled in the art, the computer 10 may also include a variety of other components such as disk drives, memory devices, etc. Further, the computer 10 may be connected to peripheral devices such as modems, printers and the like.

The cover 18 and the base 20 of the portable computer 10 are pivotally connected by one or more hinges. The hinges allow the cover 18 to be rotated with respect to the base 20 and that allows the computer to be placed in an open position such that access to the keyboard 28 and display screen 24 is provided to the user of the computer. Alternatively, the cover 18 and base 20 can be placed in a closed position to protect the computer 10 from damage and to facilitate transportation of the computer.

Figure 2A:
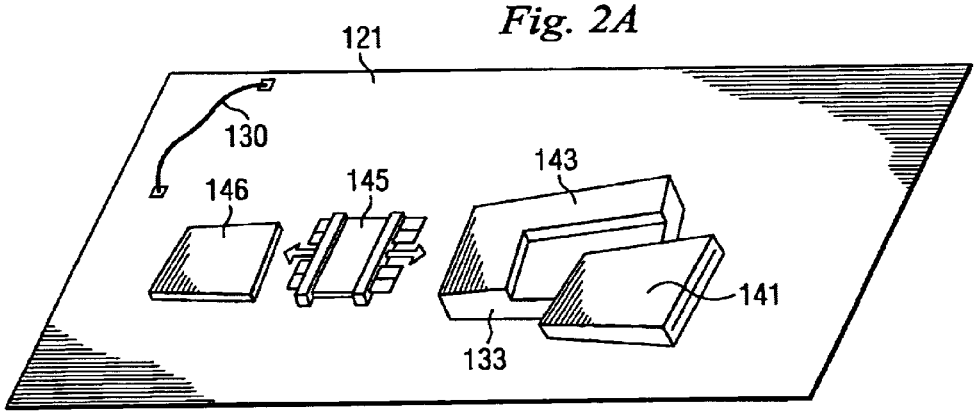
FIG. 2A is a pictorial representation of the components of one embodiment of a wireless modem.

FIG. 2A depicts an exemplary wireless adapter, or modem, 121. As shown, the wireless adapter contains a PCMCIA baseband card 146, a radio card 141, a baseband-to-radio connector 145, an antenna cabling 130, and a housing 143 containing external batteries. The baseband card 146 may be inserted into one of the PCMCIA slots 14*a* or 14*b* in the mobile computer 10. In one embodiment, a coaxial antenna cable 130 electrically couples the radio portion to the antenna. The radio card 141 has a connector 133 and the mobile computer provides a connector 131 (see also FIG. 1) that attaches to the antenna. The coaxial cable between antenna and the connector 131 is not shown. The connector 131 may be located on the system unit portion, for instance as shown, or the display portion (e.g., the side of the display nearest the PCMCIA slots or the bottom of the display portion near the PCMCIA slots). If located on the system unit portion then some of the cabling between the antenna and the connector 131 may be exposed or would require threading or routing through the display portion to the system unit portion out of the connector 131. Alternatively the connector could be located on the antenna card with the cable 130 directly connecting the antenna and radio card 141.

Figure 2B:
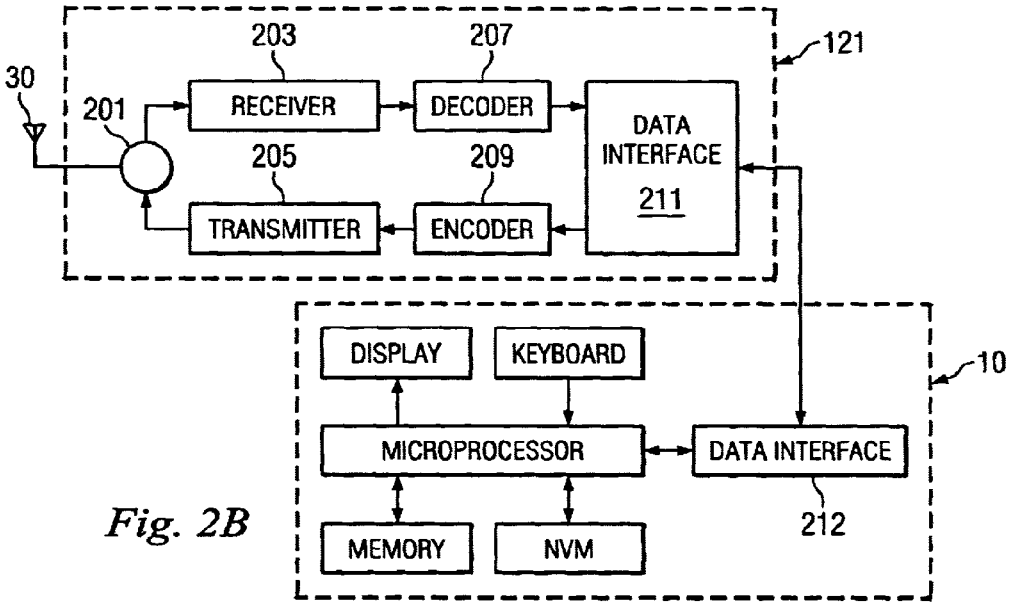
FIG. 2B is a functional block diagram of a wireless adapter for use with a portable computer system.

FIG. 2B is a functional block diagram of a generic wireless adapter 121, depicted with duplexer 201 that permits duplexing of antenna 30 between the receiver 203 and transmitter 205. Also shown is encoder 209 and decoder 207, which are typically implemented using a DSP along with data interface 211. Data interface 211 receives commands and data from the computer 112, as well as provides received data and status information to the computer 112. The data interface 212 performs the inverse function for the computer 112. In the preferred embodiment a PCMCIA-compliant interface may be utilized.

It should be noted that there exist many commercially available PCMCIA wireless adapter circuit cards that may be inserted into a laptop or a notebook computer and that enables the computer to engage in wireless communication over a network, such as a wireless LAN. (For a treatment of wireless LAN technology, see Jim Geier, Wireless LANs: *Implementing Interoperable Networks*, MacMillan Technical Publishing (1999).) Examples of wireless adapter cards include: the SA-PCR PRO.11 from BreezeCom, Inc., Carlsbad, Calif.; the DWL-650 from D-Link Systems, Inc., Irvine, Calif.; and the Cisco Aeronet 350 Series from Cisco Systems, Inc., San Jose, Calif. Except in an embodiment of the disclosure in which an information-bearing antenna is disposed on the wireless adapter card, the wireless adapter card, or its conventionally arranged components, are not per se an aspect of the disclosure, which, as will be described below, is primarily predicated on an information-bearing antenna configuration.

Figure 3:
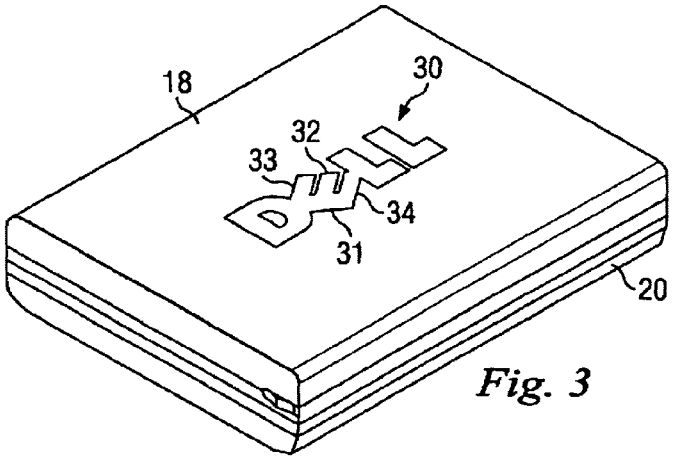
FIG. 3 is a perspective view that illustrates a logo antenna disposed on the exterior surface of the cover of a laptop computer.

FIG. 3 illustrates an antenna 30 that is disposed on the top cover 18 of a portable computer system (e.g., on the top cover of a laptop computer). In one embodiment, antenna 30 is a generally planar conductor that may be affixed to cover 18 in accordance with any of a number of known techniques. For example, the antenna may be printed or embossed on the cover. In a more rudimentary approach, antenna 30 may be affixed to cover 18 with an adhesive material, or may be mechanically attached.

Of particular significance is that the antenna is constructed in the form of the capital letter "E" and constitutes a part of a logo that identifies the source of the computer, Dell Computer Corporation. Therefore, the antenna, constructed in the form of the slant E, operates both (i) transmit and to receive RF signals in conjunction with the wireless adapter and (ii) to convey information that identifies the source of the computer. Antenna 30 may be colloquially referred to as slant E because, as may be seen in FIG. 3, the character E is oriented obliquely with respect to other characters in the logo.

Although the disclosure contemplates use of any number or kind of information-bearing characters as an antenna, or as an element of an antenna, the embodiment of FIG. 3 is notable in that the character E is formed from a number of linear segments, including a first linear segment 31 and a second linear segment 32 that extends substantially orthogonally from segment 31. Antenna 30 also includes, in embodiment of FIG. 3, third and fourth linear segments, respectively 33 and 34, that extend in a direction substantially parallel to segment 32. Furthermore, character, qua antenna, E is oriented obliquely with respect to the other characters "D," L" and "L" that constitute the logo. This orientation promotes a more nearly omnidirectional radiation pattern that provides roughly equal degrees of horizontal and vertical polarization, an intuitively salutory result in use of mobile computer systems.

As suggested above, a salient distinguishing characteristic of the disclosure is that antenna 30 serves a dual purpose as a mechanism for receiving/transmitting an RF signal and as indicia that conveys information useful to the computer user, i.e., the source of the computer system. In addition, the invention circumvents problems generally associated with the provision of external antennas for portable computers and information handling systems. To wit: the antenna does not consume inordinate extraneous space and is substantially insusceptible to damage or disruption in operation.

Figure 4:
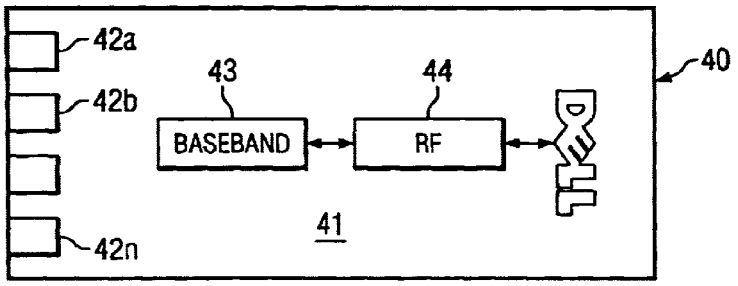
FIG. 4 is a pictorial representation of a circuit assembly in which an information-bearing antenna is printed on a circuit board.

Although a particular embodiment of antenna arrangement is described above in order to succinctly convey an understanding of the invention, the above description suggests numerous ramifications to those acquainted in the art. Clearly, the disclosure comprehends use of the antenna as a component of information-bearing content other than a logo. In addition, rather than being affixed to the top cover, some applications of the disclosure may benefit from an antenna affixed to an interior surface or to some other part of the computer system, such as, for example, base 20. In a clever manifestation, the combined antenna/logo may be printed as a , conductor on a PCMCIA wireless adapter circuit assembly. See FIG. 4. In a generally conventional fashion, the printed circuit card assembly is seen there to include a printed circuit board 41, on which are disposed at one edge of plurality of electrical contacts (or terminals) 42*a*, . . , 42*n* for effecting an interface with the mobile computing system. Circuit assembly 40 also includes a number of circuit modules 43, 44 etc. that perform functions relevant to the operation of the wireless adapter. Those skilled in the art realize that the nature, and partitioning, of the wireless adapter function may be largely assigned to the judicious discretion of the designer. However arranged, the wireless adapter may be viewed, for purposes of comprehending the subject invention, as including baseband module(s) 43, coupled to RF module(s) 44. In the instant ramification of the disclosure, the RF module is coupled to a printed circuit antenna comprising information-bearing characters as hereinabove described. Save for its implementation in the form of a printed circuit trace on printed circuit board 41, printed circuit antenna exhibits features largely analogous to the antenna implemented on top cover 18. It should be noted, however, that a degree of cabling from the wireless adapter, required for the earlier described embodiment, is obviated by the implementation illustrated in FIG. 4. Similarly, the dimensions of the logo in FIG. 4 may be different, likely smaller, than the dimensions of the characters in FIG. 3.

To be sure, it has been suggested hereinabove that inclusion of the antenna card presents a number of operational disadvantages, including inconvenience and susceptibility to damage or loss, it must nonetheless be recognized that a printed circuit antenna obviates, or at least mitigates, some of the disadvantages that inhere in other antenna systems used in wireless computing applications, and an information-bearing antenna in accordance with the disclosure is itself a desirable feature on a wireless adapter card.

Accordingly, although the present disclosure has been described in connection with several embodiments, the disclosure is not intended to be limited to the specific forms set forth herein, but on the contrary, it is intended to cover such alternatives, modifications, and equivalents as can be reasonably included with in the spirit and scope of the disclosure as defined by the appended claims.

What is claimed is:

1. An information handling system comprising:

a portable computer including a base and a cover;

a processor in the base;

an antenna in the cover;

a wireless adapter coupled to the processor;

an enclosure, enclosing the base and cover; and the antenna being in the form of a logo affixed to the enclosure and formed to convey visual information and simultaneously transfer signals to the wireless adapter.

2. The information handling system of claim 1, wherein the antenna is formed to convey information that identifies a source of the information handling system.

3. The information handling system of claim 1, wherein the antenna is substantially planar in form and is substantially entirely contiguous to a surface of the enclosure.

4. The information handling system of claim 3, wherein the antenna is formed to convey information that identifies a source of the information handling system.

5. The information handling system of claim 4, wherein the antenna comprises a first character that includes:

a first linear segment;

a second linear segment extending orthogonally from the first linear segment; and a third linear segment oriented substantially parallel to the second linear segment.

6. The information handling system of claim 5, wherein the antenna comprises a plurality of characters and the first character is oriented obliquely with respect to at least one other character.

7. An antenna as defined in claim 5, wherein the antenna comprises a plurality of characters and the first character is oriented obliquely with respect to at least one other character.

8. An antenna as defined in claim 7, wherein the antenna constitutes at least part of indicia that is associated with the source of the information handling system.

9. An antenna as defined in claim 7, wherein the antenna is substantially planar in form and is substantially entirely contiguous to a surface of the enclosure.

10. An antenna for an information handling system, the system including a portable computer having an enclosure enclosing a base and a cover, a wireless adapter in the base and an antenna affixed to the cover, the antenna comprising a logo character formed to convey visual information that identifies a source of the information handling system and simultaneously transfer signals to the wireless adapter.

11. An antenna as defined in claim 10, wherein the character comprises:

a first linear segment;

a second linear segment extending orthogonally from the first linear segment; and a third linear segment oriented substantially parallel to the second linear segment.

12. An information handling system comprising:

a portable computer including a base and a cover;

a processor in the base;

an antenna affixed to the cover;

a wireless adapter coupled to the processor;

an enclosure enclosing the base and cover; and the antenna being in the form of a logo contiguous to the enclosure for receiving signals from and transferring signals to the wireless adapter and for simultaneously conveying visual information.

13. An information handling system of claim 12, wherein the means is formed to convey information that identifies a source of the mobile computer system.

14. The information handling system of claim 13, wherein the means is substantially planar in form and is substantially entirely contiguous to a surface of the enclosure.

15. The information handling system of claim 14, wherein the means comprises a first character that includes:

a first linear segment;

a second linear segment extending orthogonally from the first linear segment; and a third linear segment oriented substantially parallel to the second linear segment.

16. The information handling system of claim 15, wherein the means comprises a plurality of characters and the first character is oriented obliquely with respect to at least one other character.

17. A printed circuit assembly for use with an information handling system, the printed circuit assembly comprising:

a printed circuit board (PCB);

a plurality of contacts disposed on the PCB for effecting an interface between the PCB and a connector associated with the information handling system;

a baseband module;

an RF module coupled to the baseband module; and a printed circuit antenna in the form of a logo affixed to an enclosure for the PCB and coupled to the RF module, wherein the printed circuit antenna is formed to convey visual information and simultaneously transfer RF signals.

18. A printed circuit assembly as defined in claim 17, wherein the antenna is formed to convey information that identifies a source of the information handling system.

19. A printed circuit assembly as defined in claim 18, wherein the antenna comprises a first character that includes:

a first linear segment;

a second linear segment extending orthogonally from the first linear segment; and a third linear segment oriented substantially parallel to the second linear segment.

20. A printed circuit assembly as defined in claim 19, wherein the antenna comprises a plurality of characters and the first character is oriented obliquely with respect to at least one other character.

* * * * *